US011411328B2

(12) United States Patent
Stjepanovic et al.

(10) Patent No.: US 11,411,328 B2
(45) Date of Patent: Aug. 9, 2022

(54) CONNECTION DEVICE FOR THE CONNECTION OF A CONDUCTOR END

(71) Applicant: Weidmüller Interface GmbH & Co. KG, Detmold (DE)

(72) Inventors: Karlo Stjepanovic, Bielefeld (DE); Stephan Fehling, Lage (DE); Stefan Fischer, Detmold (DE); Frank Hackemack, Detmold (DE); Andreas Rutz, Bielefeld (DE); Jörg Münstermann, Schlangen (DE); Marco Waldhoff, Steinheim (DE)

(73) Assignee: Weidmüller Interface GmbH & Co. KG

( * ) Notice: Subject to any disclaimer, the term of this patent is extended or adjusted under 35 U.S.C. 154(b) by 140 days.

(21) Appl. No.: 16/767,292

(22) PCT Filed: Nov. 21, 2018

(86) PCT No.: PCT/EP2018/082075

§ 371 (c)(1),
(2) Date: Oct. 22, 2020

(87) PCT Pub. No.: WO2019/105825

PCT Pub. Date: Jun. 6, 2019

(65) Prior Publication Data

US 2021/0320438 A1 Oct. 14, 2021

(30) Foreign Application Priority Data

Nov. 28, 2017 (DE) ..... 202017107209.6

(51) Int. Cl.
*H01R 4/48* (2006.01)
*H01R 11/09* (2006.01)

(52) U.S. Cl.
CPC ..... *H01R 4/4836* (2013.01); *H01R 11/09* (2013.01)

(58) Field of Classification Search
None
See application file for complete search history.

(56) References Cited

U.S. PATENT DOCUMENTS 8,388,387 B2 * 3/2013 Koellmann ..... H01R 4/4845 439/729
9,413,085 B2 * 8/2016 Hoppmann ..... H01R 4/4836
9,525,216 B2 * 12/2016 Wu ..... H01R 4/4809

FOREIGN PATENT DOCUMENTS

CN 105428914 A 3/2016
DE 4408985 A1 9/1994
(Continued)

*Primary Examiner* — Ross N Gushi
(74) *Attorney, Agent, or Firm* — Laubscher & Laubscher, P.C.

(57) ABSTRACT

A connection device for the connection of a conductor end includes a housing, a busbar section arranged in the housing, and a clamping spring assembly rotatably connected with the housing and operable between an open position and a contact position in contact with the conductor end. A rotary lever assembly is operably connected with the clamping spring assembly. The clamping spring assembly includes at least one clamping spring having clamping and actuating limbs arranged at an acute angle and connected by a bending region bearing against a spring carrier. The clamping spring assembly is preferably preassembled on the spring carrier for insertion in the housing.

23 Claims, 21 Drawing Sheets

(56) References Cited

FOREIGN PATENT DOCUMENTS

| | | | |
|---|---|---|---|
| DE | 69703829 | T2 | 7/2001 |
| DE | 202005012792 | U1 | 2/2006 |
| DE | 202011051516 | U1 | 1/2013 |
| DE | 102012011794 | A1 | 12/2013 |
| DE | 102014100354 | A1 | 7/2015 |
| DE | 202015102045 | U1 | 7/2016 |
| DE | 202015105022 | U1 | 12/2016 |
| EP | 3041089 | A1 | 7/2016 |
| WO | 2013185893 | A1 | 12/2013 |

* cited by examiner

Fig. 7a
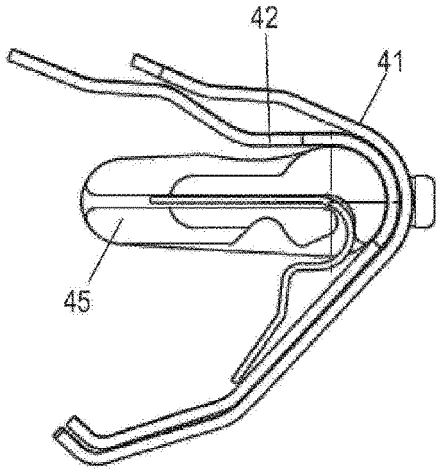
Fig. 7b
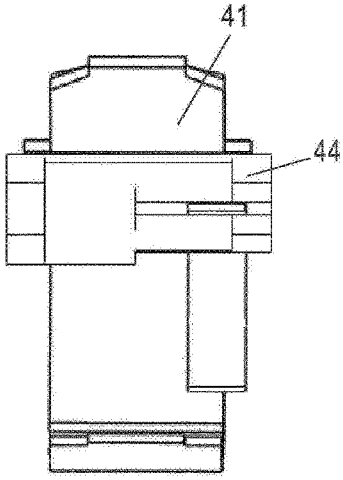
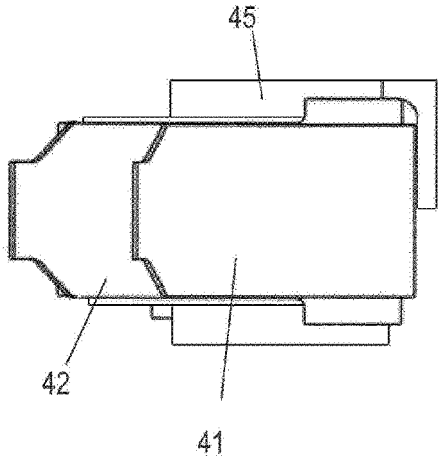
Fig. 7c
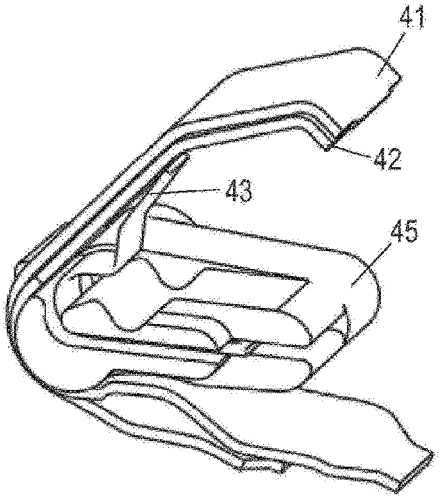
Fig. 7d

Fig. 8d
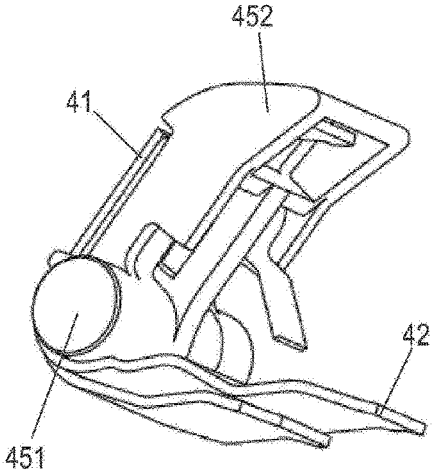
Fig. 8c
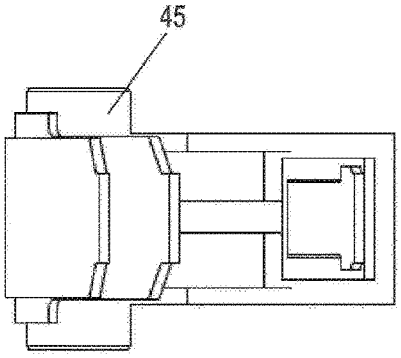
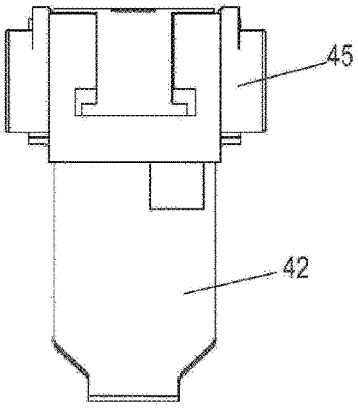
Fig. 8b
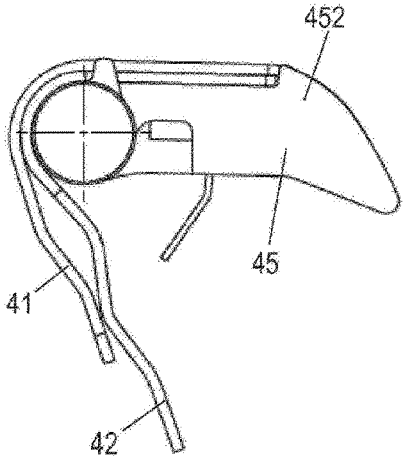
Fig. 8a

CONNECTION DEVICE FOR THE CONNECTION OF A CONDUCTOR END

This application is a § 371 National Stage Entry of International Patent Application No. PCT/EP2018/082075 filed Nov. 21, 2018. Application No. PCT/EP2018/082075 claims priority of DE 20 2017 107 209.6 filed Nov. 28, 2017. The entire content of these applications is incorporated herein by reference.

BACKGROUND OF THE INVENTION

The invention relates to a connection device for the connection of a conductor end.

Connection devices of this type are known in the art. However, with regard to the handling and structural design of the known connection devices, they are only able to be actuated with difficulty, specifically when contacting conductors of larger diameter, and therefore require improvement.

Against this background, the object of the invention is to provide a connection device which is improved in terms of the handling and structural design thereof.

SUMMARY OF THE INVENTION

The invention provides a connection device for the connection of a conductor end, which connection device has a housing and also a busbar section, a clamping spring assembly and a rotary lever assembly in the housing. The clamping spring assembly can be rotated, with the aid of the rotary lever assembly, from an open position to a contact position in which contact is made with the conductor end, the clamping spring assembly including one or more clamping springs which are each embodied as leaf springs and each have at least one clamping limb and at least one actuating limb.

The clamping limb and the actuating limb are oriented at an angle, preferably at an acute angle of between 5° and 85°, in relation to one another and are connected to one another by a bending region, the bending region of at least one of the leaf springs bearing against a spring carrier. The spring carrier is preferably separate from the housing and the clamping spring assembly can be preassembled on the spring carrier. As a result, the assembly and mounting of the springs can be greatly facilitated.

In accordance with one embodiment which further optimises mounting, the preassembled unit can be inserted into the housing individually and separately or together with another element, in particular together with the busbar section.

In this context, in an alternative embodiment, the preassembled unit can be fixed in the housing or on the associated busbar section, for example in a positive and/or non-positive fit, in particular by clamping and/or latching.

To simplify mounting the clamping springs, the spring carrier has one or more mounting devices, in particular one or more slots, for mounting the one or more clamping springs.

In another embodiment, the spring carrier is pivotably arranged in the housing. It can then be part of the spring operation, in particular the operation of the actuating limb or of an extension of the actuating limb.

The spring carrier has one or more mounting devices, in particular one or more slots, for mounting a restoring spring to integrate this function into the spring carrier in a simple manner. In this context, the restoring spring is formed as a further leaf spring.

In a further embodiment, the rotary lever assembly includes a cam section which includes a projection or a pin or the like inserted into said the cam section which engages in a slotted link of the housing, and a clamping and/or latching device is formed on the cam section and is movable in the slotted link into a fixing position formed in the busbar section. In this manner, reliable contacting of a conductor and reliable release of the conductor from the end contact position can take place in a simple manner.

The end contact position is durably securely fixed on the metal busbar and not in the plastics material housing. In this context, attaching a pin to the cam section and forming the latching position in the slotted link of the busbar section provides a particularly simple embodiment for implementing fixing of the spring assembly in the end contact position, which also results in simple and consistent usability when establishing and releasing the contact position.

The clamping and/or latching device is preferably a pin, in particular a metal pin, which is movable in the slotted link into a fixing position.

It may further be provided that in the housing, before the latching position is reached, the slotted link transitions into a corresponding slotted link in the associated busbar section or in the ends in this section. The slotted link has a point, in particular a constriction point or a top-dead-center point, at which the pin is fixed securely in position when the end contact position is reached in such a way that the end contact position is durably securely fixed at the metal busbar section. Specifically, for releasing the end contact position, it is merely necessary to move the pin out of the latching position behind the constriction point in the slotted link by rotating the rotary lever assembly.

In this way, when the end contact position is reached, the clamping limb or limbs press on the conductor end, the clamping spring assembly and/or the rotary lever assembly additionally being locked on a thrust bearing in a positive and/or non-positive fit by a locking device.

In a preferred embodiment, the rotary lever assembly and the clamping spring assembly may—always or at least during the rotation from the open position into the contact position—have the same direction of rotation. However, it is also possible for them to have opposite directions of rotation. If they have identical directions of rotation, this has the advantage that the actuating force for switching remains low in spite of a high force on the clamping spring assembly. As a result of the increasingly large lever, the torque increases for the same actuating force.

To achieve more favourable actuating forces, preferably high contact forces and a compact, narrow design, the axis of rotation D1 of the clamping spring assembly and sections of the clamping spring assembly are arranged above the conductor end to be contacted and above the associated busbar section, and the rotary lever assembly has an axis of rotation D2 which is positioned above the axis of rotation D1 of the clamping spring assembly.

In a further preferred embodiment, the busbar section may be configured trough-shaped, in particular V- or U-shaped, in cross section, the conductor end being insertable into the busbar section perpendicular to this cross section, and the clamping spring assembly being designed to be pivoted, at least in sections, into the busbar section transverse to the conductor insertion direction so as to press the conductor end in the end contact position into the trough-shaped busbar section so as to contact this section. The invention is particularly well-suited to a structural configuration of this type.

It may further be provided that the rotary lever assembly has a rotary lever element which is rotatably mounted in the housing preferably in or on a central section, and has the axis of rotation D2 and that the rotary lever element preferably has the cam section, which has—preferably on the surface thereof facing the clamping spring assembly—a control curve on which the actuating limb or limbs of the clamping springs slide during movement into the end contact position. The assembly and the lever ratios thereof can be adjusted for any angle of rotation and can thus be optimally adapted to the force requirement.

To ensure a well-guided movement into and out of the end contact position, a projection of the cam section or a pin or the like is inserted into the section and engages in a slotted link of the housing, specifically in an arc-shaped slotted link.

To secure the end contact position, in the end contact position, the clamping spring assembly and/or the actuating limb are additionally fixed, by a locking device, in a positive and/or non-positive fit, for example on the busbar section or on another element.

For this purpose, a clamping and/or latching device, for example the aforementioned pin which is movable into a fixing position in the slotted link, may be formed on the cam section with the fixing position formed in the—preferably metal—busbar section, since in this way a high contact force can also be durably ensured.

The actuating limb or limbs are formed elbowed at the free ends thereof so as to slide on the control curve.

If an actuating limb is arranged rotationally engaged in the spring carrier, the spring carrier may also join with the operation of this actuating limb in whole or in part. In this case, the carrier also forms part of the clamping spring assembly.

BRIEF DESCRIPTION OF THE FIGURES

Other objects and advantages of the invention will become apparent from a study of the following description when viewed in the light of the accompanying drawing, in which:

FIGS. 7*a* to 7*d* are top, side, front, and perspective views, respectively of a first embodiment of a clamping spring assembly such as is used for example in the series terminal of FIG. 1; and FIGS. 8*a* to 8*d* are top, side, front, and perspective views, respectively, of a second embodiment of a clamping spring assembly such as is used for example in the series terminal of FIG. 3.

DETAILED DESCRIPTION

Figure 1A:
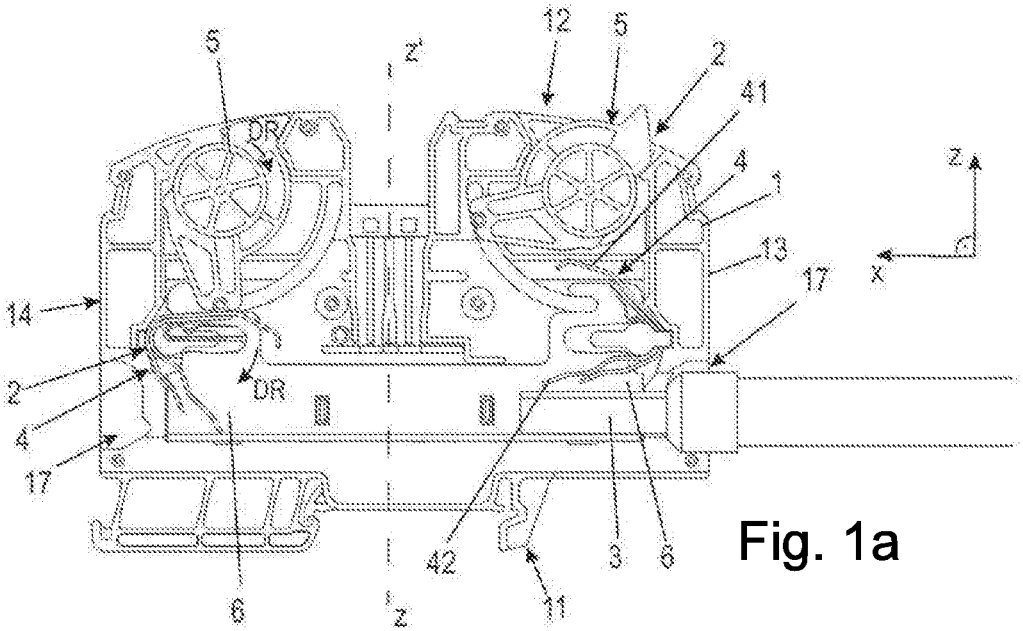
FIG. 1*a* is a sectional view of a series terminal including connection devices according to the invention, of which one is in a first, closed operating position, without a conductor end inserted into it, and of which the other, second connection device is in an open, first operating position upon insertion of the conductor end.
Figure 1B:
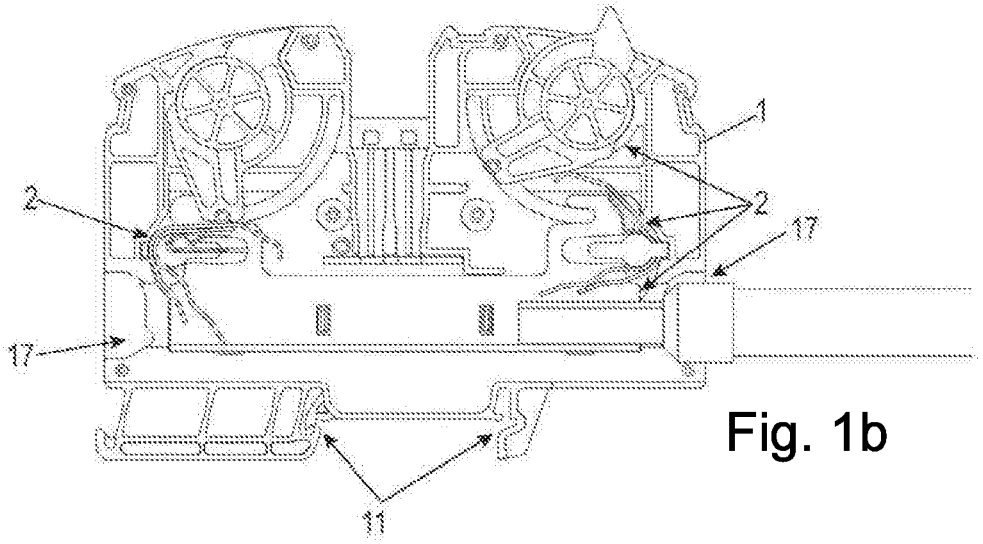
FIGS. 1*b* to 1*e* show the series terminal of FIG. 1*a*, the second connection device in each case being or having been moved, in successive steps, respectively, into a contact position which is reached in FIG. 1*e;*
Figure 1C:
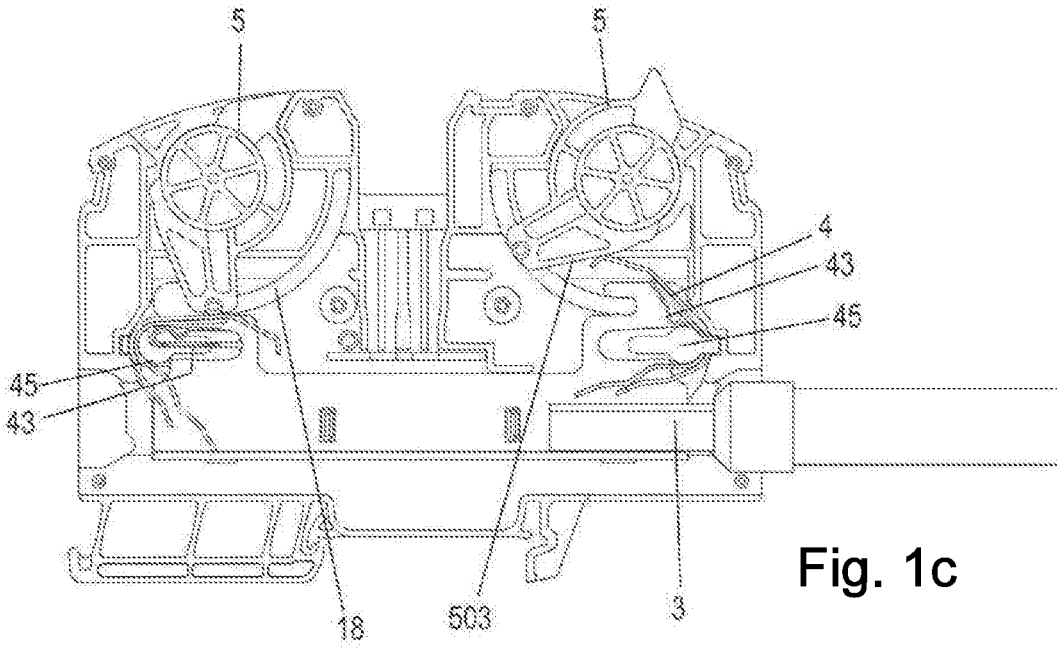
Figure 1D:
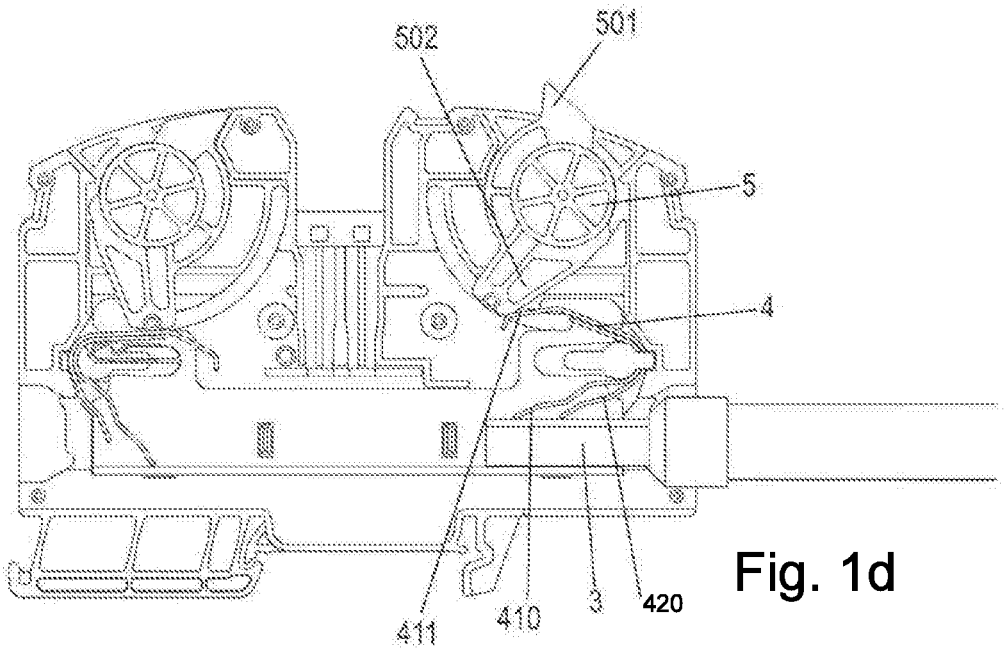

For simplicity, a Cartesian coordinate system X/Z is illustrated in FIG. 1, the direction perpendicular to the plane of the page being designated as the Y-direction. In the following, the conductor insertion direction is designated as the X-direction.

FIG. 1 shows a housing 1, which in this case is formed as a terminal housing. One or more—in this case two—connection devices 2 for connecting an associated conductor end 3 are arranged in the housing. In FIG. 1, only conductor end 3 is shown. The conductor ends 3 are portions of conductor wires from which insulation has been removed. The conductor ends may be single wires or multiple or stranded conductors or for example crimped wire ends of a highly electrically conductive material, such as copper.

The housing 1 is formed of electrically insulating material, in particular of a non-conductive plastics material. The housing 1 is formed disc-shaped in this case and is preferably configured to be stackable in the Y-direction perpendicular to the conductor insertion direction. The terms right, left, up and down are based on the portrayal in the drawings, and accordingly change when the housing 1 moves in space.

The housing 1 may have an affixing foot 11. In this case, said foot is formed for placement, in particular latching, on a carrier rail (not shown). The housing 1 further has an upper surface 12 (this being the surface remote from the mounting foot 11) and two plug-in surfaces 13, 14. In an (imaginary) coordinate system, the direction perpendicular to the plane of the drawing is designated as the Y-direction (the carrier rail extending in this direction), the direction perpendicular to the carrier rail (in FIG. 1 the vertically upward direction) as the Z-direction, and the direction perpendicular thereto (leftwards in FIG. 1) as the X-direction. The two conductor ends 3 are movable in and counter to the X-direction. Thus, the conductor insertion direction of the right conductor end 3 into the right connection device 2 is the X-direction and the conductor insertion direction of the left conductor end (not shown) into the left connection device 2 is the −X-direction.

The connection devices 2 may be formed identically or be symmetrical with respect to one another, in other words mirror-symmetrical about the imaginary plane z-z' perpendicular to the plane of the drawing. As a result, two conductor ends 3 can be easily inserted into the housing 1 from opposite sides and can be contacted therein by the associated connection device 2. This is shown in the embodiment of FIGS. 1-3. One, two as shown, or even more of the connection devices may be arranged in a housing, and thus are arranged side by side (for example in a multi-part housing 1).

The connection devices 2 each have a clamping spring assembly 4 and a rotary lever assembly 5. In addition, they each have a busbar section 6 against which the associated conductor end can be pressed or pushed by the clamping spring assembly. The clamping spring assembly 4 acts in the manner of a compression spring in each case.

In FIG. 1, the busbar sections 6 are configured in a single piece with one another, in such a way that the two connection devices 2 are conductively connected by in this case a single-piece busbar. In this way, a through-terminal is implemented between the two connection devices without an electrical functional module. The two busbar sections 6 may be formed as separate busbars which are conductively interconnected directly or via at least one electrical or electronic component.

Figure 1E:
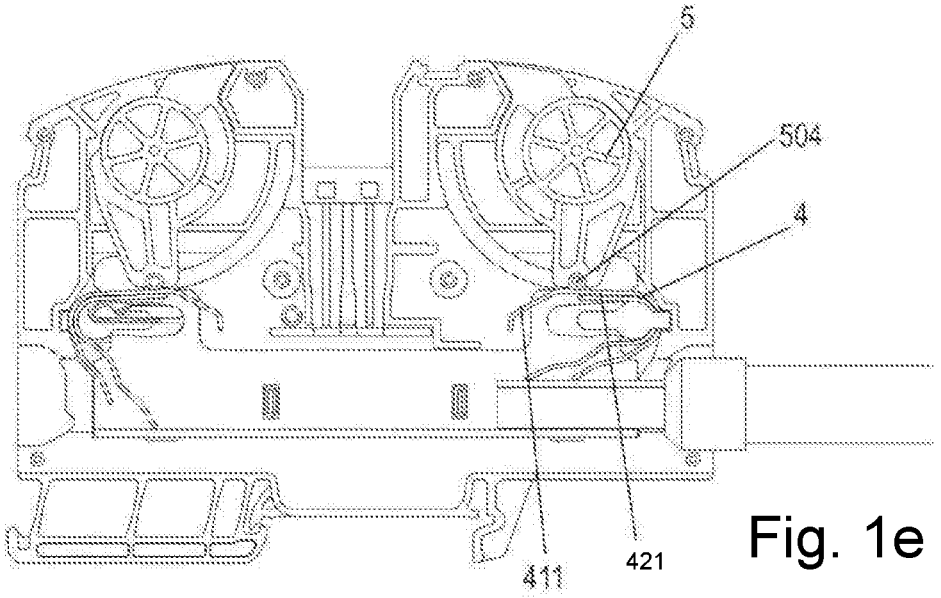
Figure 1F:
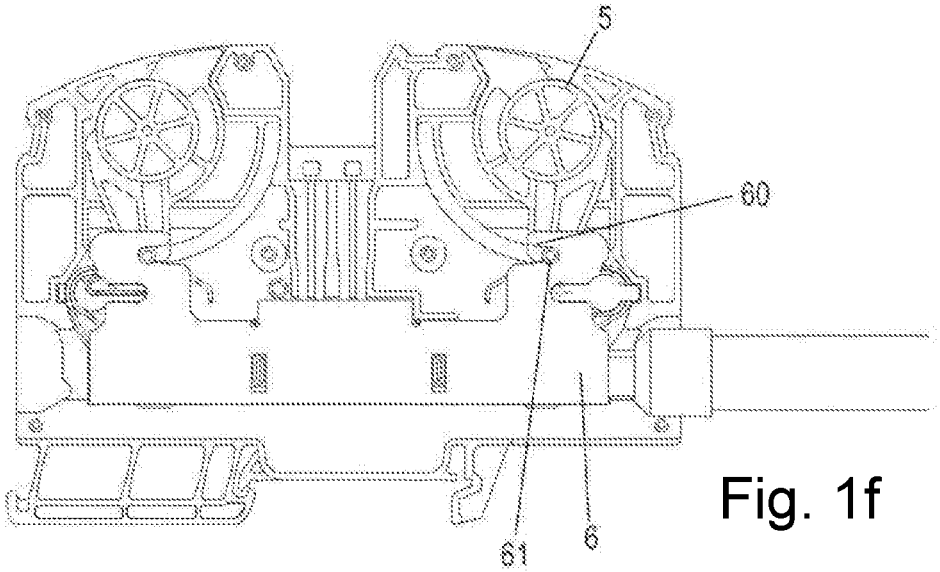
FIG. 1*f* is a side view of the series terminal in the operating position of FIG. 1*e*, without a side wall that is optionally further attached/formed on the side.
Figure 1G:
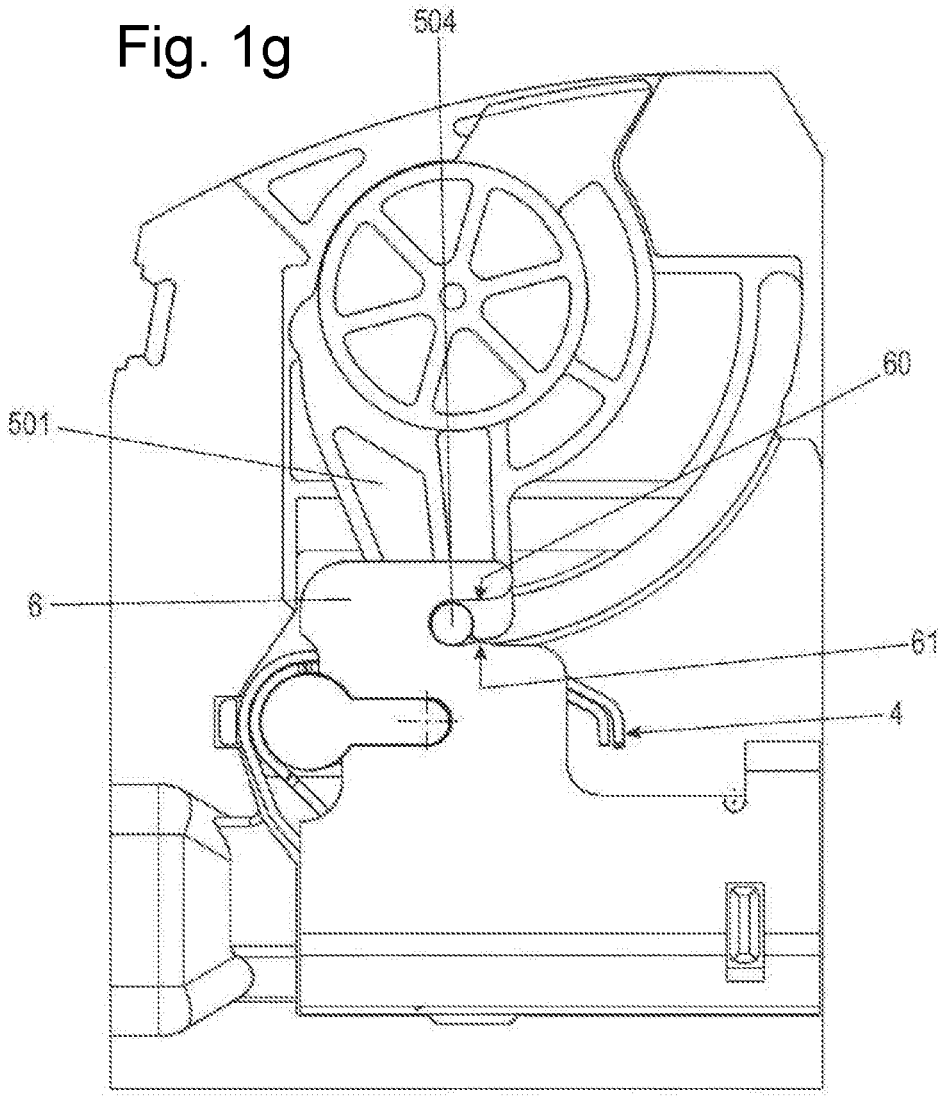
FIG. 1*g* is an enlarged detail of a series terminal formed substantially in accordance with FIG. 1*f;*

The busbar sections 6 preferably have a V or U shape in cross section as shown in FIG. 1*f*. The primary extension direction of the busbar sections 6 is the X-direction perpendicular to the V or U cross section. The associated conductor end 3 is inserted into the connection devices 2 parallel to the primary extension direction (+X, −X) in each case. For this purpose, in the extension of the associated busbar section 6, each housing 1 has an insertion opening 17 for the conductor. The V or U shape may extend over the entire length of the busbar assembly in the primary extension direction or else over part of the length.

The clamping spring assembly 4 is designed in such a way that, for introducing the associated conductor end 3, it is pivotable out of the busbar section 6 so that a conductor end 3 is insertable into the associated busbar section 6 through the insertion opening 17. To contact the conductor, the clamping spring assembly 4 as a whole is pivoted towards and partially into the busbar section 6, with the conductor end 3 being contacted. The clamping spring assembly 4 finally takes on a fixed position in the contact position and presses the conductor end 3 against the associated busbar section 6 which is made of electrically highly conductive material, in such a way that at least one contact point through which an electric current can flow is formed.

The clamping spring assembly 4 includes one or more clamping springs 41, 42 (shown in FIGS. 2*a* and 3*a*), which are embodied as leaf springs. In FIG. 1, two leaf springs are provided, and serve to generate a sufficient contact force. These leaf springs each have at least one clamping limb 410, 420 and at least one actuating limb 411, 421. The at least one clamping limb 410, 420 and the at least one actuating limb 411, 421 are angled, preferably acute-angled at an angle of between 5° and 85° to one another. They are further preferably each interconnected via a bending region 412, 422 or a sort of radius. The bending region 412, 422 is preferably positioned on a spring carrier 45. In FIGS. 2 and 3, the conductor end is not shown so as to better illustrate the rotational movement of the clamping spring assembly 4, which otherwise is influenced by the action of the clamping limb 410, 420 on the conductor end 3.

In addition, there is a further leaf spring 43, which is a restoring spring.

The spring carrier 45 may be formed in a single piece with the housing 1 or as a separate part from the housing. If it is formed separately from the housing 1, it is advantageous for the clamping spring assembly 4 to be capable of being preassembled on the spring carrier 45, and for the preassembled unit subsequently to be insertable into the housing 1 separately and fixable therein, for example in a positive and/or non-positive fit, in particular by clamping and/or latching.

The spring carrier 45 may also be arranged pivotably in the housing. In this case, it may even—if the actuating limb is arranged rotationally engaged thereon—join in with the operation of this actuating limb 410 in whole or in part as shown in FIG. 3. In this case, the carrier forms part of the clamping spring assembly 4.

The clamping springs 41, 42 of the leaf spring assembly are preferably arranged laid inside one another in a stackable manner. This means that the bending regions 412, 422 thereof are positioned inside one another and have exactly or substantially the same axis of rotation D1 or D1'. In this case, the support contour has a rounded journal section 451, about which the clamping springs 41, 42 can be rotated in the bending regions 411, 412 thereof. The spring carrier 45 serves, in the manner of a bolt, in the region in which the bending region 412, 422 is positioned against it, as a pivot bearing for the clamping spring assembly or for the one or more individual springs or clamping springs of the clamping spring assembly 4.

The spring carrier 45 may have one or more slots 453, 454 (FIG. 5) in which one or more of the springs 41, 42 and 43 are respectively insertable and capable of being preassembled. In this way, these springs 41, 42, 43 and the spring carrier 45 form a preassembled unit, which is preassembled as a whole and subsequently undergoes further mounting.

Figure 4:
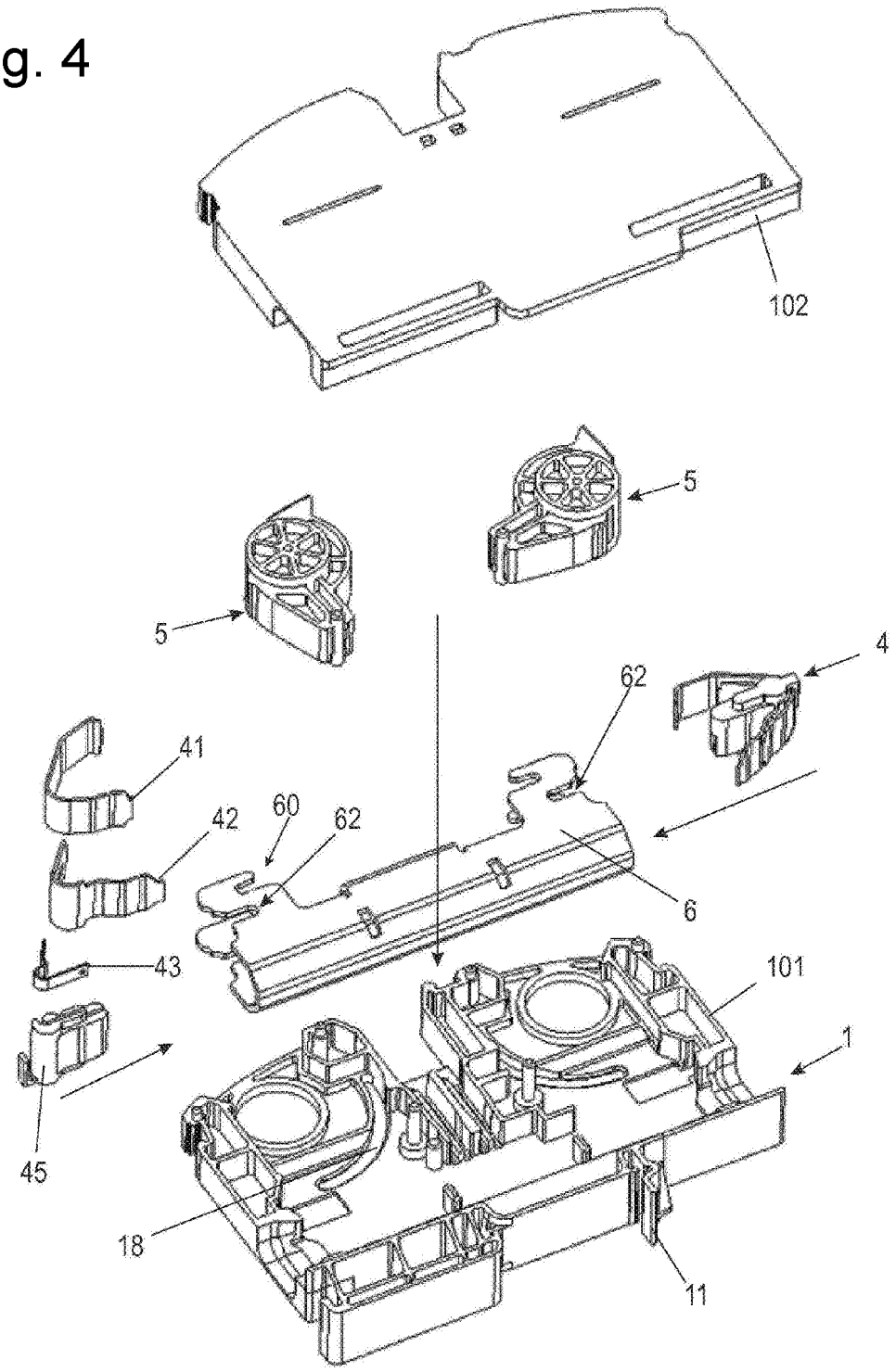
FIG. 4 is an exploded view of the series terminal of FIG. 1.
Figure 5A:
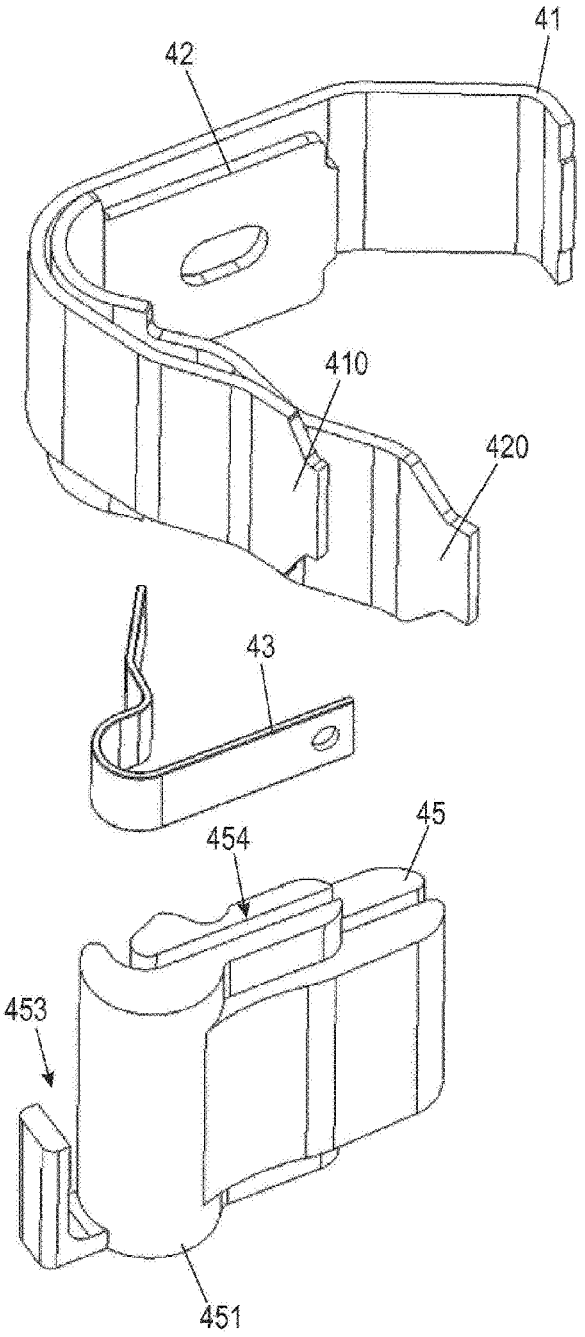
FIG. 5*a* is an exploded view of a clamping spring assembly for a series terminal of FIG. 1.
Figure 5A:
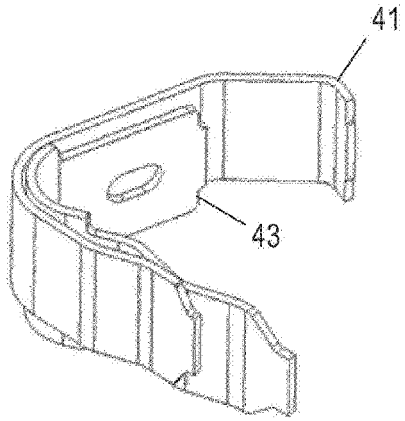
Figure 5B:
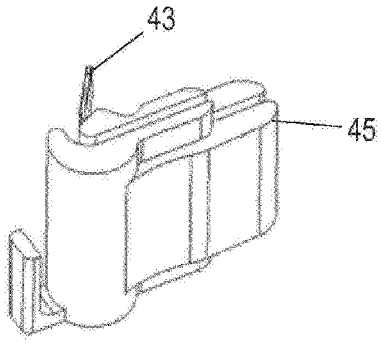
FIG. 5*b* is an exploded view of a first a first step for mounting a leaf spring of the clamping spring assembly.
Figure 5C:
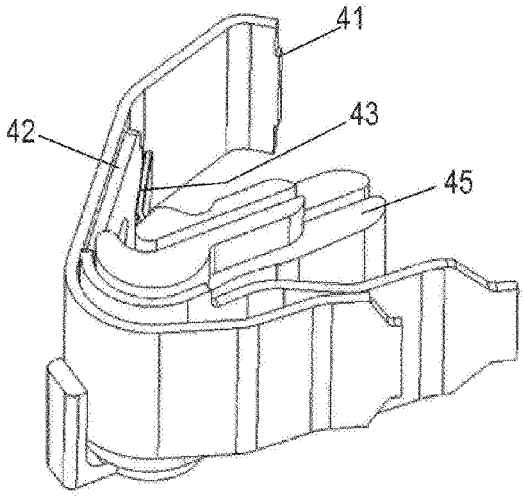
FIG. 5*c* is a perspective view of the assembled clamping spring assembly.
Figure 6A:
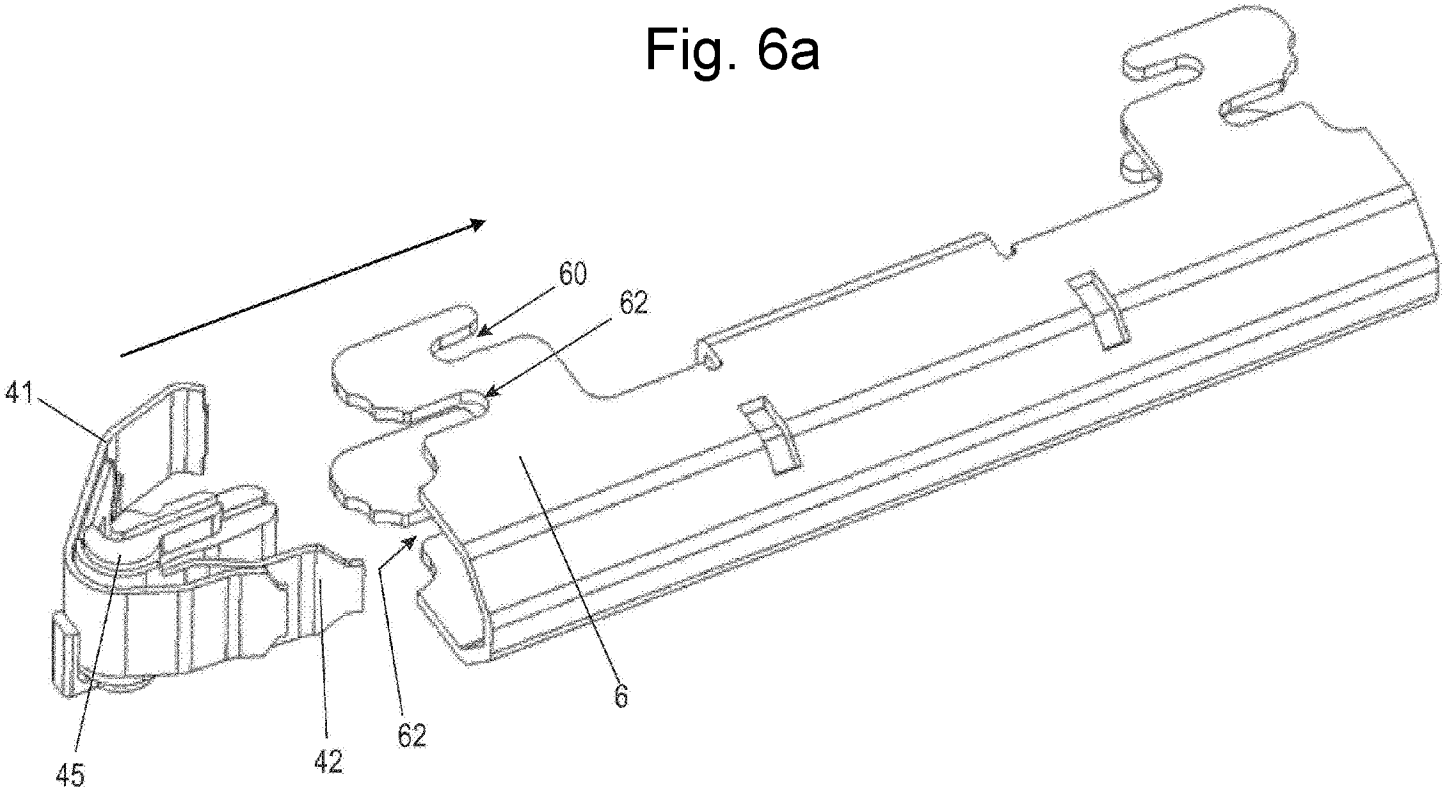
FIGS. 6*a* and 6*b* are exploded and perspective views, respectively which illustrate mounting of the clamping spring assembly of FIG. 5 on a busbar such as is in the series terminal of FIG. 1.
Figure 6B:
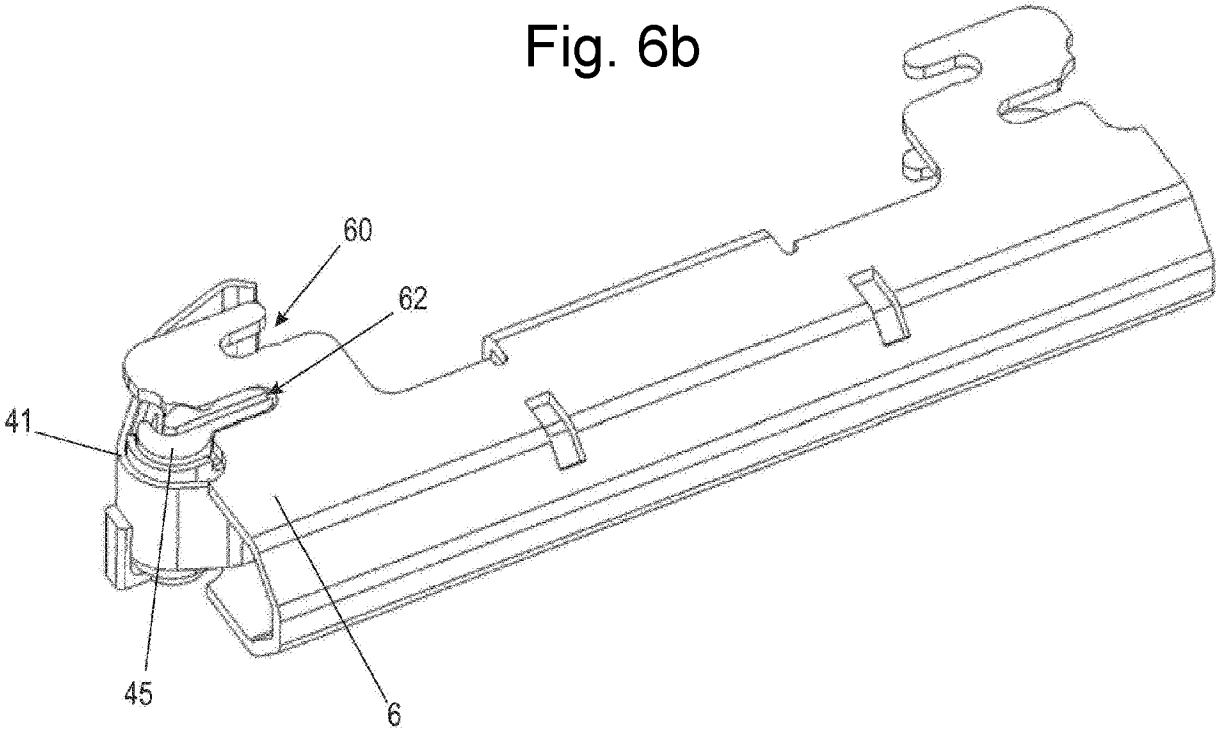

In this embodiment, the busbar 6 has, at both ends or at each busbar section 6, a slot 62 in the two limbs of the busbar of U- or V-shaped cross section into which the spring carrier 45 is insertable. The busbar 6 thus forms, with the preassembled clamping spring assembly or assemblies 4, a preassembled unit which is preassembled as a whole and inserted into the clamping housing 1 as shown in FIG. 4 and FIG. 6). This further simplifies the mounting.

Preferably, the actuating limbs 411, 421 and/or the clamping limbs 410, 420 of the leaf springs 41, 42 are of different lengths. If the actuating limbs 411, 421 are of different lengths, this makes it possible to contact conductor ends 3 of different diameters at positions, respectively, well-suited thereto, in a simple manner. It is also conceivable to contact a single conductor end 3 using two or more leaf springs at different points.

The clamping spring assembly 4 is preferably oriented in such a way that the bending region 412, 422 is closest to the associated conductor insertion opening 17, so that the clamping limb 410, 420, proceeding from the bending region 412, 422 extends away from the conductor insertion opening 17. The associated clamping limb 410, 420 and the associated actuating limb 411, 421 are thus preferably positioned at an acute angle to the conductor insertion direction (i.e. the X-direction).

The axes of rotation D1 of the clamping spring assemblies 4 and sections of the clamping spring assemblies 4 are positioned in the region of the support contour, or the support contour is positioned above the conductor end 3 to be contacted and above the associated busbar section 6 in the Z-direction—in other words perpendicular to the mounting foot or to the carrier rail. The associated rotary lever assembly 5, which has an axis of rotation D2, is further arranged above the clamping spring assembly 4 in the Z-direction. The axis of rotation D2 is positioned above the axis of rotation D1 of the clamping spring assembly in the Z-direction.

Overall, an assembly is produced in such a way that in the housing 1, for each connection device 2, the busbar assembly 6 is arranged below and the open face of the V- or U-shaped cross section thereof is directed towards the associated clamping spring assembly 4 in such a way that the clamping limb or limbs 410, 420 are pivotable into the busbar assembly. In addition, the axis of rotation D2 of the rotary lever assembly 5 is formed and arranged above the clamping spring assembly 4. In this context, the directions of rotation DR of the rotary lever assembly 5 and DR of the clamping spring assembly 4 are in the same direction or orientation. Thus, in the left connection device of FIG. 1 they each rotate clockwise for contacting, and in the right connection device 2 of FIG. 1 they each rotate counterclockwise for contacting. For release, they are each rotated in the reverse direction.

Figure 2A:
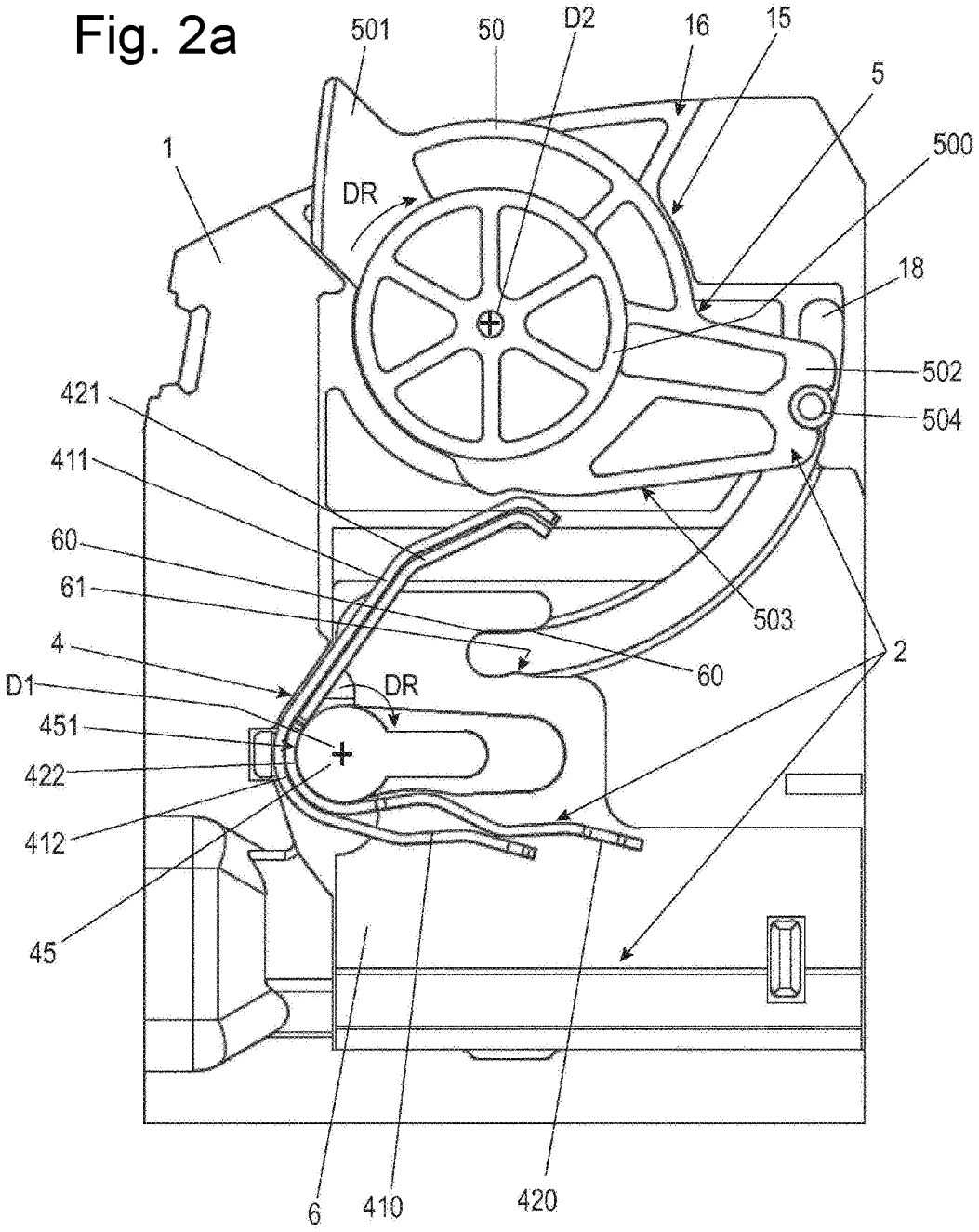
FIGS. 2*a* to 2*f* are portions of the sectional view of FIG. 1*a* with the first connection device in various operating positions, in which it is moved from an open position into a contact position—without a conductor—from FIGS. 1*a* to 1*e;*
Figure 2B:
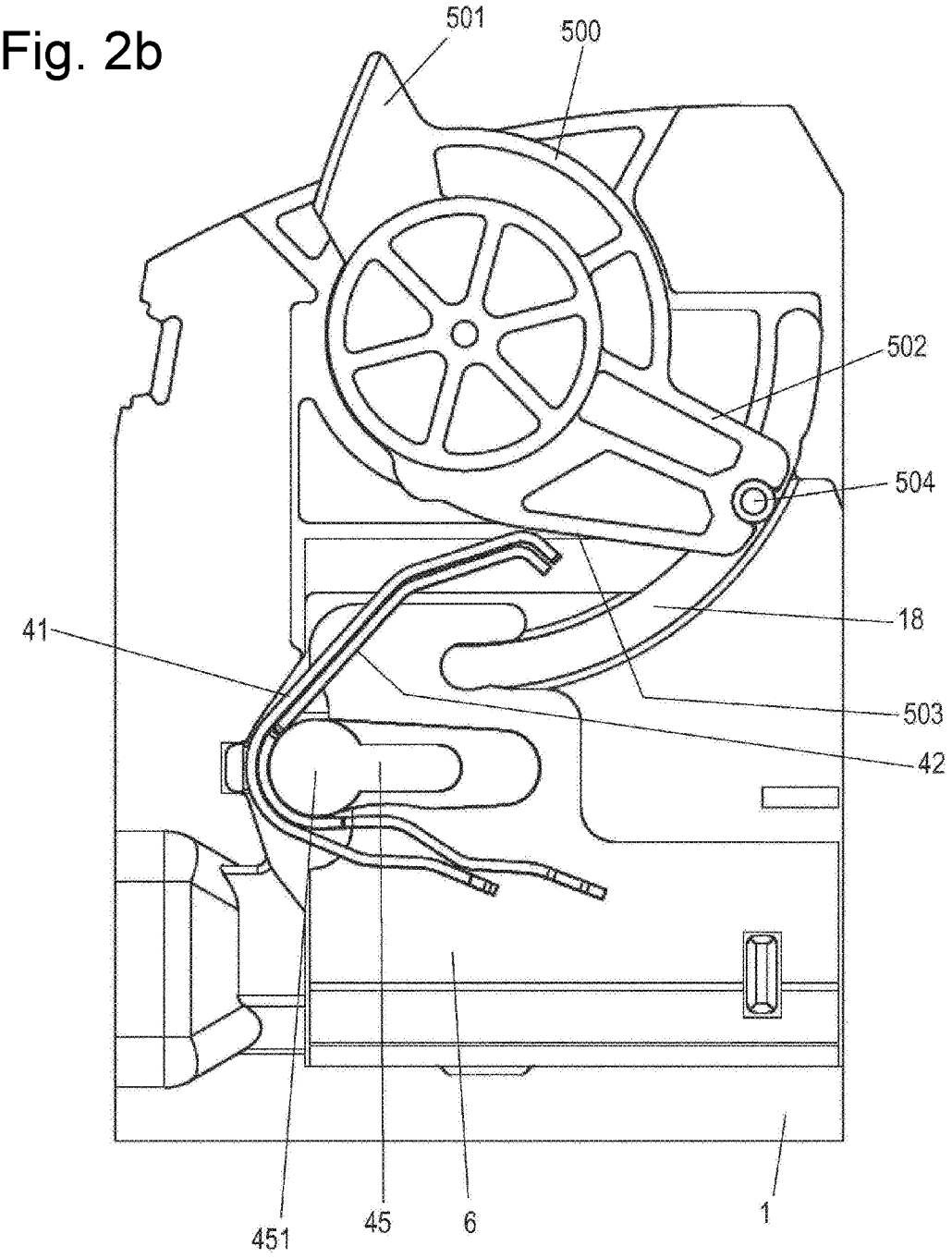
Figure 2C:
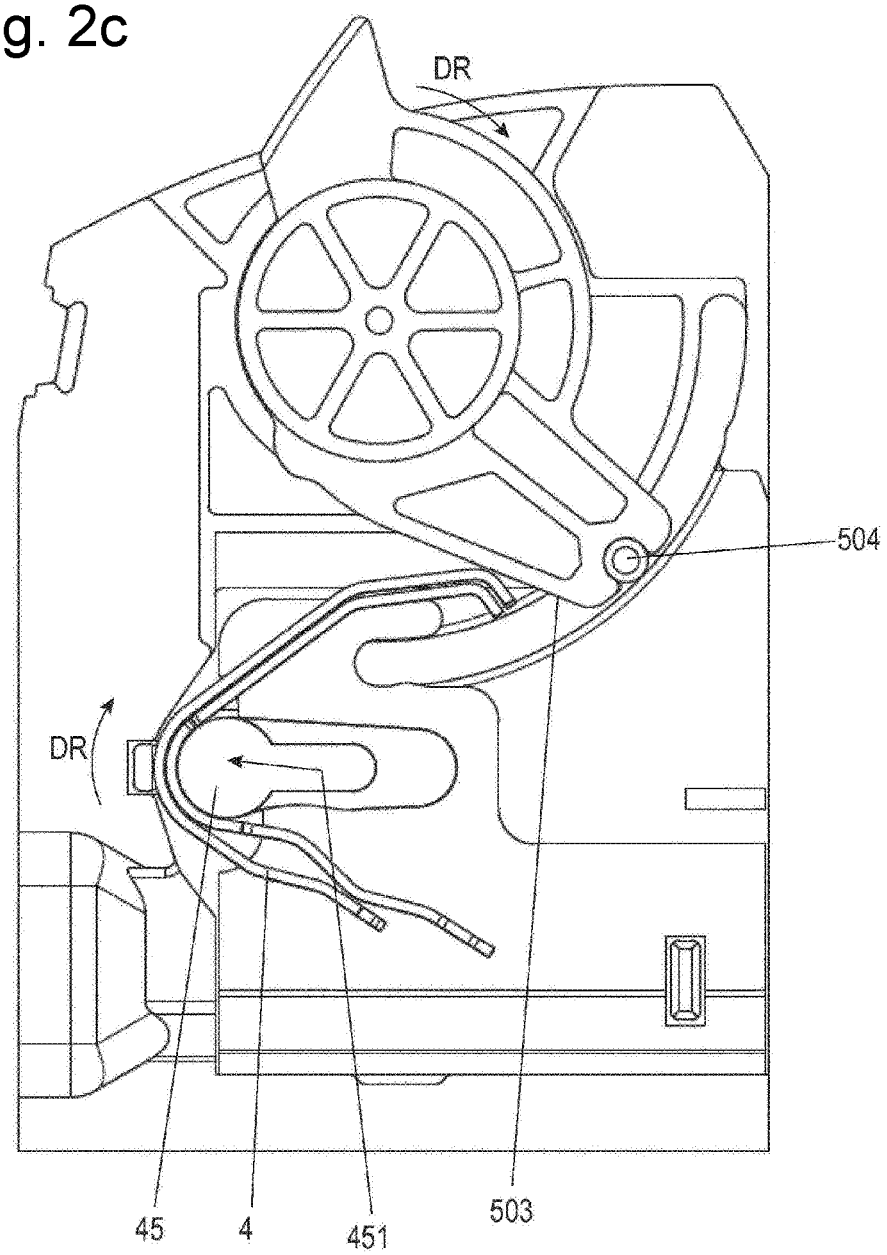
Figure 2D:
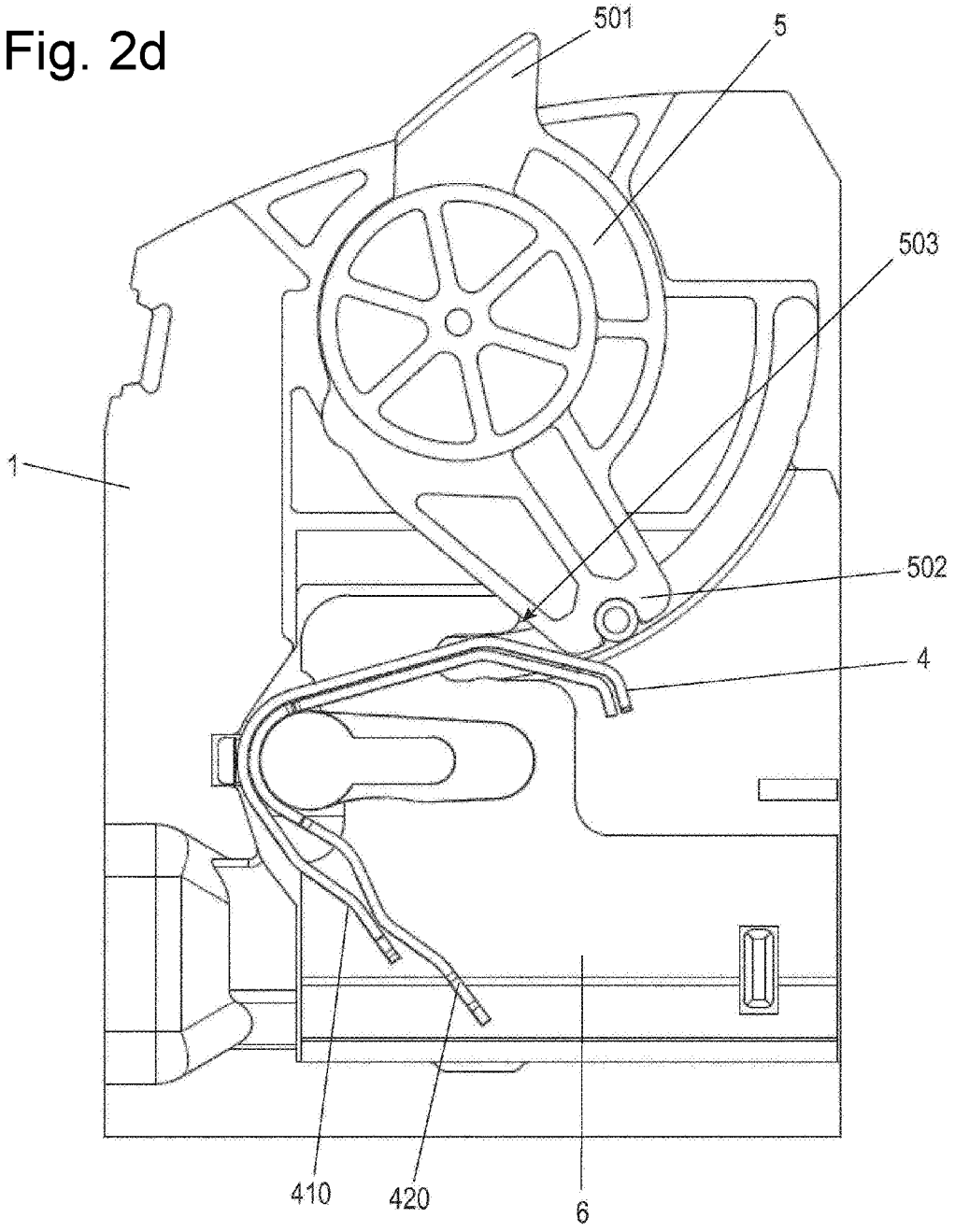
Figure 2E:
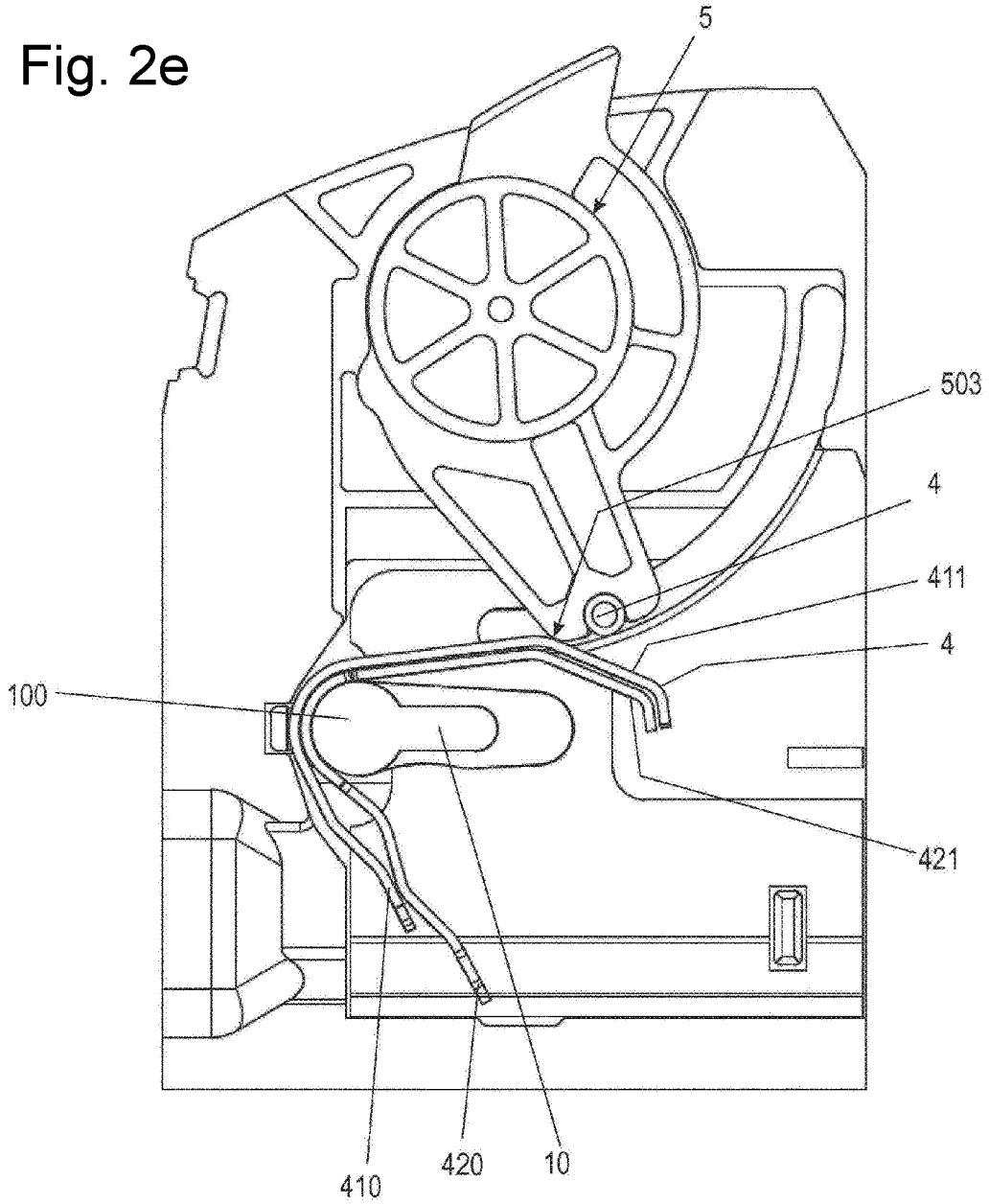
Figure 2F:
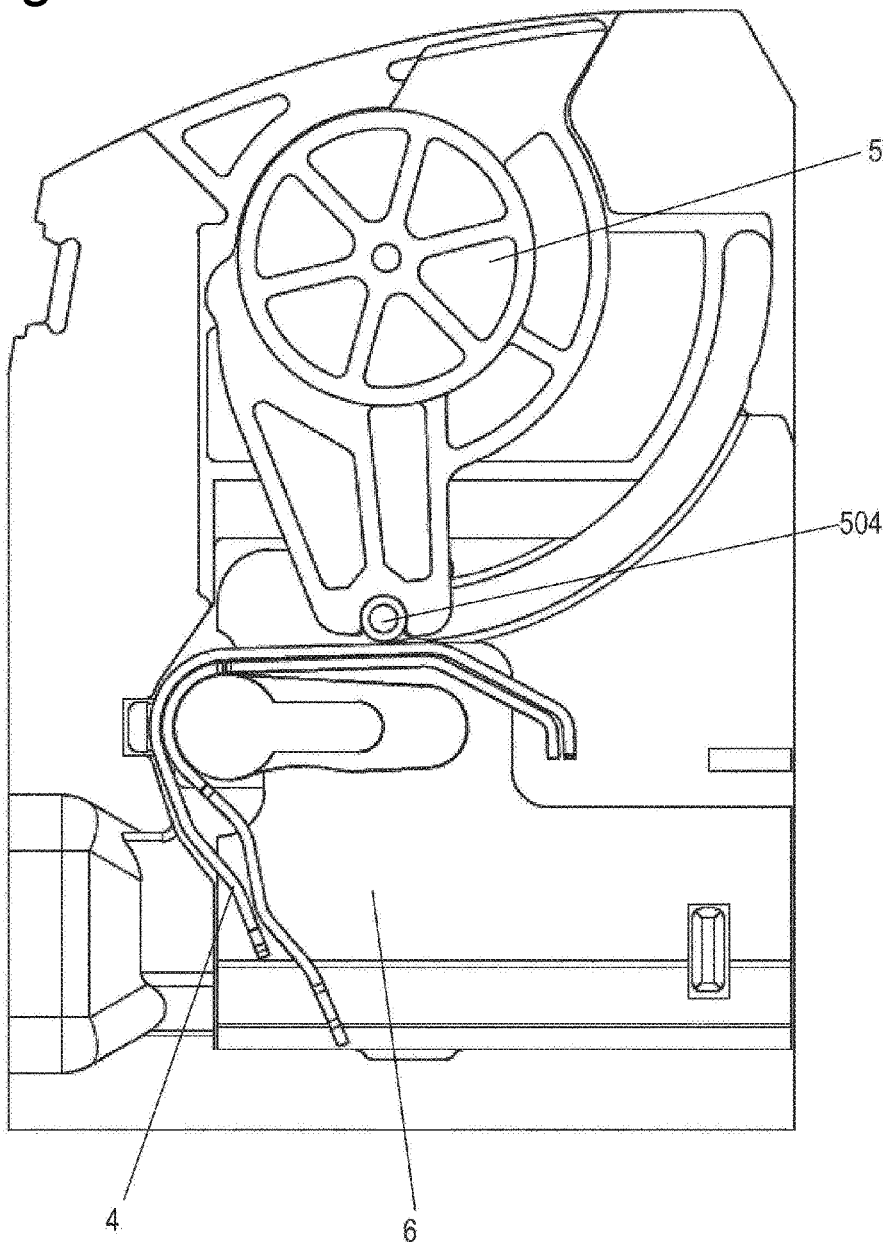
Figure 3A:
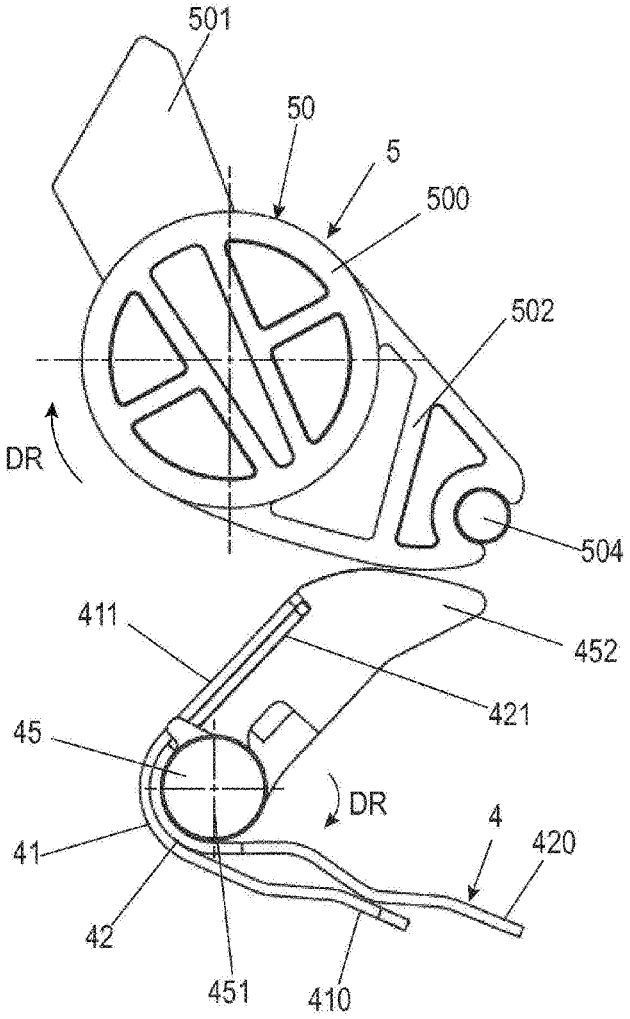
FIGS. 3*a* to 3*d* are enlarged side views which show movable elements of an alternate embodiment of the connection device of FIG. 2 in various operating positions, respectively, in which the connection device is moved from an open position into a contact position—without a conductor—from FIGS. 3*a* to 3*d;*
Figure 3B:
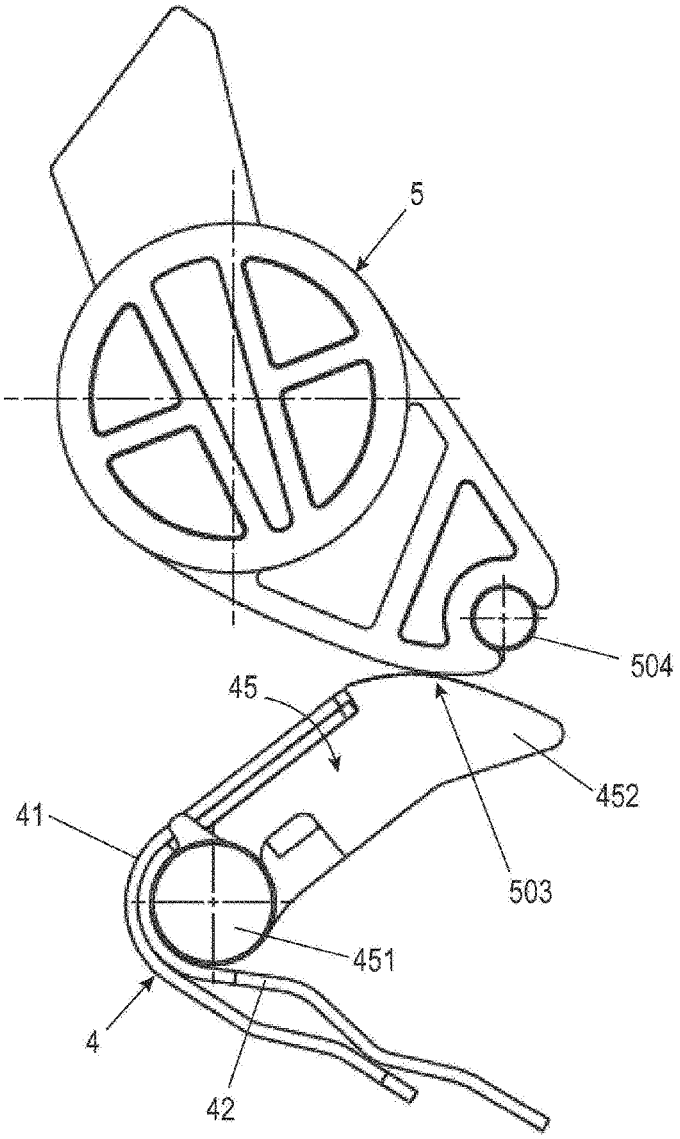
Figure 3C:
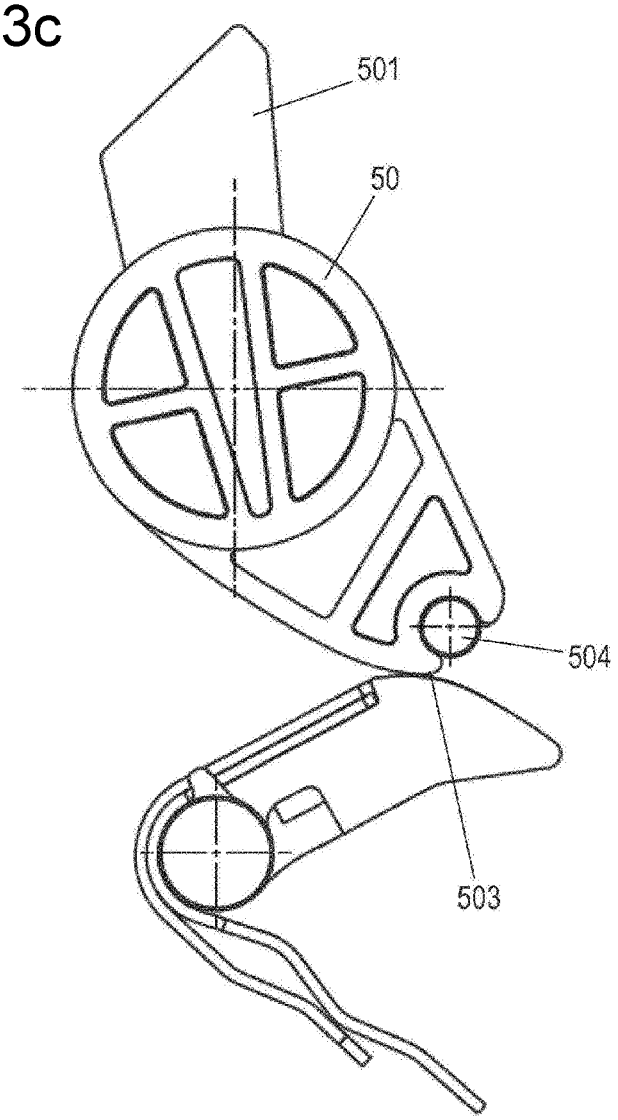
Figure 3D:
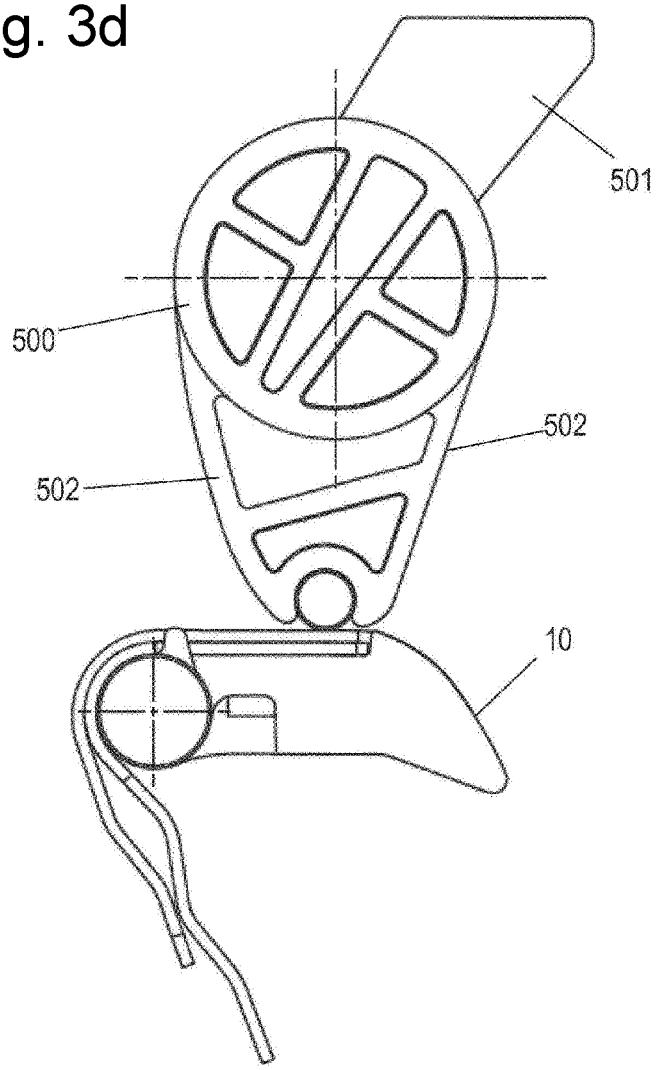

Using the rotary lever assembly 5, the clamping spring assembly 4 can be pivoted from an open position (FIG. 1*a*) (via the plurality of intermediate steps of FIGS. 1*b* to 1*d*, FIGS. 2*a* to 2*e*, FIGS. 3*a* to 3*e*) into a contact position (FIGS. 1*e*, 2*e*, and 3*d*). The rotary lever assembly 5 has a cam-like configuration. The rotary lever assembly 5 has a preferably disc-like rotary lever element 50, which is rotatably mounted in the housing 1 preferably in or on a central section 500 and has the axis of rotation D2. This can be implemented in various ways. For example, the rotary lever element 50 may be placed on or passed through by a journal in the housing 1, and/or may be inserted into a rotary receiving contour 15 of the housing 1—such as a recess—which in any case encloses it in sections on the outer periphery.

The rotary lever element 50 has an actuating section 501, which is preferably accessible from outside the housing 1, in particular at an opening 16 on the upper surface 12 of the housing 1. The actuating section 501 may for example be formed as a shoulder protruding radially from the central section 500 or as an opening, in the region 500, which makes it possible to apply a tool, in particular a screwdriver or the like. The section may also serve as a stop for delimiting the angle of rotation, in and/or counter to the direction of rotation, in cooperation with an opening 16 of the housing from which it projects as shown in FIG. 2*a*.

The rotary lever element 50 further has a cam section 502. In the present case, the cam section 502 is configured as a sort of arm, which extends radially outwards, eccentrically, substantially tangentially, with respect to the central section 500.

The cam section 502 has, on the surface thereof facing the clamping spring assembly 4, a sort of control curve 503, against which the actuating limb or limbs 411, 412 of the clamping springs 41, 42 can be brought to bear.

A projection of the cam section 502 or a pin 504 or the like inserted into the section may engage in a slotted link, in particular an arc-shaped slotted link 18, of the housing 1, providing a particularly secure and uniform opening movement.

In the completely open state, the cam section 502 may be positioned on the actuating limbs 411. However, this is not required. Rather, it is also conceivable for the section to be positioned somewhat spaced apart from the clamping spring assembly 4, as shown in FIG. 1*a*, in the completely open position.

The clamping spring assembly 4 may be held—for example using an ancillary spring (not shown)—in the opening position of FIG. 2, or the conductor end 3 of the assembly may be moved into position when the rotary lever assembly 5 is rotated into the opening position thereof, in which the cam section 502 is rotated upwardly away from the busbar section 6.

In the position of FIG. 1*a*, the rotary lever assembly 5 thus releases the clamping spring assembly 4, in such a way that it can be pivoted around by a tool or the conductor in a direction of rotation "−DR", to the left in FIG. 2*a* or FIG. 3*a* or to the right in the right connection device in FIG. 1*a*. As a result, a conductor end 3 can be inserted into the corresponding connection device—on the right in FIG. 1*a* or on the left in FIG. 2*a*.

To establish the contact position, the rotary lever assembly 5 is now rotated in a direction of rotation "DR" counter to the direction of rotation "−DR", in such a way that the control curve 503 of the cam section 502 comes to bear against the clamping spring assembly 4 (FIG. 2*b*). Upon further rotation in the direction of rotation DR (FIGS. 1*c*, 1*d*, 2*b*, 2*c*, 3*b*, and 3*c*), the cam section 501 acts like a rotary lever—in the present case like an increasingly long rotary lever—on the actuating limb or limbs 411, 421. In the present case, it acts on the outer actuating limb 411 and presses it downwards in the −Z-direction (in other words downwardly in the direction of the carrier rail). As a result, the entire clamping spring assembly 4 is rotated in a direction of rotation DR identical to the direction of rotation DR. This presses the clamping limb or limbs 410 harder and harder against the conductor end 3 and presses the end against the associated busbar section 6.

It is particularly advantageous that, as a result of the identical directions of rotation, the effective lever arm, by which the cam section acts on the actuating limb 411, 421 in the region of the control curve of the section, becomes larger and larger during the movement from the opening position into the contact position. This is beneficial because the actuating force can be kept relatively low as a result. This is apparent from a comparison of FIG. 1*b* to FIG. 1*f* for the right side of the series terminal. These drawings show that the point or region at which the cam section 501 touches the clamping spring assembly 4 migrates radially further outwardly on the cam section 501 from picture to picture with increasing closing or pressing of the clamping spring assembly 4 against the conductor. This occurs until the pin 504 in the radially outermost region of the cam section 501 is reached.

In FIG. 1, the end contact position is reached in FIG. 1*f*. In this position, the actuating limbs 411, 421 and/or the rotary lever assembly 5 can additionally be fixed in a positive and/or non-positive fit, for example on the busbar section 6 or on another element, in such a way that a particularly stable end contact position is implemented, which is not released even under relatively high stresses.

The advantages described above were not recognised, or insufficiently recognised, in the prior art, since therein the focus was on other, less important points in the structural implementation. The invention deviates from this, and instead focuses on reliably achieving uniform wiring movement and unwiring movement and achieving a high contact force in the end contact position.

Thus, the actuating limb or limbs 411, 421 may be formed with elbows at the free ends thereof so as to ensure reliable sliding of the control curve on the actuating limb or limbs 411, 421.

When the end contact position is reached, the clamping limb or limbs 410, 420 press on the conductor end (FIGS. 1*d* and 1*e*), preferably until the clamping spring assembly 4 and/or the rotary lever assembly 5 are fixed on a thrust bearing in a positive and/or non-positive fit.

Preferably, a latching device, for example the aforementioned pin 504, is formed on the cam section 502, and is movable into a fixing position in the slotted link 18. This fixing position is formed in the busbar. For this purpose, the slotted link 18 in the housing transitions into a corresponding slotted link 60 in the associated busbar section 6, or rather ends in this section, before the latching position is reached. The slotted link 60 may have, in the associated busbar section, a constriction point 61 or a top-dead-center point in which the pin 504 is fixed securely in place, in particular latched, when the end contact position is reached. This can be seen in FIG. 1*g*. The slotted link 18 is aligned with the slotted link 60. Specifically, for releasing the end contact position, it is merely necessary to move the pin from the latching position behind the constriction 61 of the slotted link 60 in the busbar by rotating the rotary lever assembly 5.

It is advantageous if the end contact position is durably securely fixed on the metal busbar 6 and not in the plastics material housing 1. In this case, attaching a pin 504 to the cam section and forming the latching position in the slotted link 60 of the busbar section 6 provides a particularly simple embodiment for fixing the spring assembly in the end contact position, which also results in simple, uniform operability when establishing and releasing the contact position. It is also advantageous for release from the end contact position, that no latching hook or the like on the spring assembly has to be released from a locking position.

FIG. 4 illustrates, in an exploded view, the design of a series terminal in the manner of Fig. The disc-like design of the housing 1 in a stackable configuration can clearly be seen. In addition, the disc-like housing 1 may be constructed in a plurality of parts. The housing 1 may for example be composed of two half-shells 101 and 102. In one or both of the half-shells 101, 102, the slotted link 18 may be formed, which is aligned, at one end thereof, with the slotted link 60 in the associated busbar section 6 in each case. The other half-shell is formed as a rear wall.

The spring carrier 45 may be formed integral with the housing 1 or as a separate part from the housing. If it is formed separately from the housing 1, it is advantageous for the clamping spring assembly 4 to be preassembled on the spring carrier 45 and for the preassembled unit subsequently to be separately insertable into the housing 1 and fixable therein, in particular by clamping and/or latching. The spring carrier 45 may be formed in a single piece or multiple pieces. It may also include two halves which are folded together when the clamping springs and/or release springs are mounted.

The spring carrier 45 may also be pivotably arranged in the housing. In this case the carrier may join with the operation of the actuating limb 410 if the actuating limb is rotationally engaged thereon. This functionality is shown in FIG. 3. In this case, the carrier forms part of the clamping spring assembly 4.

The clamping springs 41, 42 of the leaf spring assembly are preferably arranged inside one another in a stackable manner. This means that the bending regions 412, 422 thereof are positioned inside one another and have exactly or substantially the same axis of rotation D1 or D1'. In this case, the support contour has a rounded journal section 451 about which the clamping springs 41, 42 can be rotated in the bending regions 411, 412 thereof. In this case, the spring carrier 45 serves as a bolt in the region in which the bending region 412, 422 is positioned against it, as a pivot bearing for the clamping spring assembly, or for the one or more individual springs or clamping springs of the clamping spring assembly 4.

The restoring spring 43 is likewise formed as a V-shaped leaf spring. This is moved into a compressed position in the end contact position. Here, it is positioned internally with respect to the two clamping springs 41 and 42. If the rotary lever assembly 5 is released from the fixing position thereof, or in the present case the latching position of the contact position (corresponding to the left side of FIG. 1*c*), and rotated back into the unwired opening position, the restoring spring 43, which is braced by a support limb against the spring recess as shown in FIG. 1, relaxes. In this way, the restoring spring 43 presses against the actuating limbs 411, 412 of the two clamping springs 41, 42 from the inside, and the clamping spring assembly 4 as a whole also rotates back into the opening position again. This restoring functionality is implemented in a reliable manner in a small installation space using a simple device.

In FIG. 3, the spring carrier 45 is pivotably arranged in the housing 1. Since the actuating limb 411 or 412 is rotationally arranged and engaged on the carrier, it joins in whole or in part with the operation of this actuating limb 411. This is shown in FIG. 3. Over a portion of the rotational movement, the cam section 502 acts on the spring carrier 45 or on an arm 452 of the spring carrier and also rotates the contact spring(s). The clamping limb or limbs project beyond the spring carrier 45, and the ends thereof are free. and function as clamping spring limbs. The spring carrier 45 thus also forms part of the clamping spring assembly 4. The springs 41, 42, 43 are in turn preassembled on the spring carrier—preferably at slots 453, 454—which thus in turn forms a unit which is preassembled and which can be mounted on the busbar 6 or directly in the clamping housing as shown in FIGS. 7*a*-7*d*.

FIGS. 8*a* to 8*d* are top, side, front, and perspective views, respectively, of a second embodiment of a clamping spring assembly such as is used in the series terminal of FIG. 3.

The invention claimed is:

1. A connection device for the connection of a conductor end, comprising (a) a housing;

(b) a busbar section arranged in said housing;

(c) a clamping spring assembly rotatably connected with said housing and operable between an open position and a contact position in contact with the conductor end, said clamping spring assembly including at least one clamping spring having at least one clamping limb and at least one actuating limb arranged at an acute angle relative to one another and connected by a bending region bearing against a spring carrier, said clamping spring assembly and said busbar section being insertable together into said housing; and (d) a rotary lever assembly operatively connected with said clamping spring assembly.

2. A connection device as defined in claim 1, wherein said rotary lever assembly includes a rotary lever element rotatably mounted rotatably in a central section of said housing and which has an axis of rotation.

3. A connection device as defined in claim 2, wherein Said rotary lever element includes an actuating section.

4. A connection device as defined in claim 2, wherein said rotary lever element has a cam section having a control curve surface on which said actuating limb of said clamping spring slides during movement into the contact position, and wherein said cam section includes a projection which extends into a slotted link of said housing and is movable in said slotted link into a fixing position formed in said busbar section.

5. A connection device as defined in claim 4, wherein said rotary lever element cam section control curve surface engages an actuating limb of said leaf spring and increases in curvature during movement of said clamping spring assembly into the contact position.

6. A connection device as defined in claim 4, wherein said actuating limbs are elbowed at the free ends thereof which slide on said control curve.

7. A connection device as defined in claim 4, wherein said clamping device projection comprises a pin which is movable in said slotted link into the fixing position.

8. A connection device as defined in claim 7, wherein said housing slotted link transitions into a corresponding slotted link in said busbar section, said busbar slotted link including a constriction point at which said pin is secured in position when the contact position is reached, whereby the contact position is securely fixed at said busbar section.

9. A connection device as defined in claim 1, wherein said clamping spring assembly is arranged above the conductor end and above said busbar section, said axis of rotation of said rotary lever assembly being positioned above an axis of rotation of said clamping spring assembly.

10. A connection device as defined in claim 1, wherein said spring carrier and clamping spring assembly is connected with one of said housing and said busbar section in a positive and/or non-positive fit by clamping and/or latching.

11. A connection device as defined in claim 1, wherein said spring carrier contains at least one first slot for mounting one or more of said clamping springs.

12. A connection device as defined in claim 11, wherein said spring carrier contains a second slot, and further comprising a restoring spring connected with said spring carrier second slot.

13. A connection device as defined in claim 12, wherein said restoring spring comprises a leaf spring.

14. A connection device as defined in claim 1, wherein said rotary lever assembly includes a cam section which engages said spring carrier and rotates said spring carrier with said clamping spring assembly.

15. A connection device as defined in claim 1, wherein said clamping sprint assembly comprises a pair of clamping springs are arranged inside one another with said bending regions positioned inside one another and have the same axis of rotation.

16. A connection device as defined in claim 1, wherein said clamping spring actuating limb and clamping limb are of different lengths, respectively.

17. A connection device as defined in claim 1, wherein aid spring carrier includes a rounded journal section about which said at least one clamping spring is rotated in said bending region thereof.

18. A connection device as defined in claim 1, wherein aid clamping limbs press on the conductor end when the contact position is obtained, said clamping spring assembly and said rotary lever assembly being locked in a positive and/or non-positive fit.

19. A connection device as defined in claim 1, wherein in the contact position, said clamping spring assembly and said rotary lever assembly are fixed in a positive and/or non-positive manner on one of said busbar section and said housing.

20. A connection device as defined in claim 1, wherein said rotary lever assembly and said clamping spring assembly have the same direction of rotation during rotation from the open position into the contact position.

21. A connection device as defined in claim 1, wherein said busbar section has a trough-shaped cross section configuration, the conductor end being insertable into the busbar section perpendicular to its cross section, said clamping spring assembly being pivoted into said busbar section transverse to the conductor insertion direction to press the conductor end in the contact position into the trough-shaped busbar section to contact said busbar section.

22. A connection device as defined in claim 1, wherein said acute angle is between 5° and 85°.

23. A connection device for the connection of a conductor end, comprising (a) a housing;

(b) a busbar section arranged in said housing;

(c) a clamping spring assembly rotatably connected with said housing and operable between an open position and a contact position in contact with the conductor end, said clamping spring assembly including at least one clamping spring having at least one clamping limb and at least one actuating limb arranged at an acute angle relative to one another and connected by a bending region bearing against a spring carrier, wherein said spring carrier is pivotably arranged within said housing; and (d) a rotary lever assembly operatively connected with said clamping spring assembly.

* * * * *